US007455151B2

(12) United States Patent
Perez

(10) Patent No.: US 7,455,151 B2
(45) Date of Patent: Nov. 25, 2008

(54) ELEVATOR ROLLER GUIDE

(75) Inventor: Jose Sevilleja Perez, Madrid (ES)

(73) Assignee: Otis Elevator Company, Farmington, CT (US)

( * ) Notice: Subject to any disclaimer, the term of this patent is extended or adjusted under 35 U.S.C. 154(b) by 206 days.

(21) Appl. No.: 10/551,243

(22) PCT Filed: Apr. 7, 2003

(86) PCT No.: PCT/US03/10563

§ 371 (c)(1),
(2), (4) Date: Sep. 28, 2005

(87) PCT Pub. No.: WO2004/099055

PCT Pub. Date: Nov. 18, 2004

(65) Prior Publication Data

US 2006/0175151 A1 Aug. 10, 2006

(51) Int. Cl.
*B66B 7/04* (2006.01)

(52) U.S. Cl. ..... 187/410; 104/245

(58) Field of Classification Search ..... 187/410, 187/226; 104/245, 247; 267/140, 153; 105/30, 105/32, 33

See application file for complete search history.

(56) References Cited

U.S. PATENT DOCUMENTS

| | | | | | |
|---|---|---|---|---|---|
| 1,854,976 | A * | 4/1932 | Brady | ..... | 187/406 |
| 2,253,820 | A * | 8/1941 | Spiro | ..... | 187/410 |
| 2,260,922 | A * | 10/1941 | Spiro | ..... | 187/410 |
| 3,329,240 | A * | 7/1967 | Harwood et al. | ..... | 187/410 |
| 5,107,963 | A | 4/1992 | Rocca et al. | | |
| 5,331,900 | A * | 7/1994 | Gersemsky | ..... | 105/30 |
| 5,544,722 | A | 8/1996 | McKenzie | | |
| 6,006,867 | A | 12/1999 | Richter et al. | | |
| 6,050,370 | A | 4/2000 | Jung | | |
| 6,345,698 | B1 * | 2/2002 | Ravishankar | ..... | 187/410 |

FOREIGN PATENT DOCUMENTS

| | | | | |
|---|---|---|---|---|
| EP | 525812 A2 * | 2/1993 | ..... | 187/410 |

* cited by examiner

*Primary Examiner*—Peter M Cuomo
*Assistant Examiner*—Stefan Kruer
(74) *Attorney, Agent, or Firm*—Carlson, Gaskey & Olds

(57) ABSTRACT

A guiding device (30) for an elevator system (20) facilitates guiding a cab (22) along guide rails (24). The guiding device (30) includes a roller mount (34) that supports rollers (36) such that the rollers remain a fixed distance from each other. A biasing member (44) urges the mount (34) in a direction that maintains contact between the guide rail (24) and the rollers (36) and facilitates centering the guiding device (30) and the cab (22) relative to the guide rails (24).

20 Claims, 3 Drawing Sheets

ELEVATOR ROLLER GUIDE

BACKGROUND OF THE INVENTION

1. Field of the Invention

This invention generally relates to elevator systems. More particularly, this invention relates to a roller guide device for use in an elevator system.

2. Description of the Prior Art

Elevator systems are well known. A cab typically is guided within a hoistway along guide rails that extend vertically within the hoistway. Various configurations of guiding arrangements have been developed to provide smooth movement of the cab along the guide rails.

Typical guiding arrangements include rollers that roll along corresponding surfaces on a nose of the guide rail. One challenge facing designers of such devices is to provide for appropriate tolerances in the spacing of the rollers so that smooth movement of the cab is achieved by appropriate cooperation between the rollers and the guide rail nose surfaces. Manufacturing tolerances and variations in the surfaces on the guide rails make it difficult to have one roller guide device design be readily incorporated into a variety of elevator systems.

Another concern is maintaining contact between the guide rail and the rollers under the elevator operating conditions. For example, the cab may shift during travel because of weight shifts within the cab or other forces tending to move the cab laterally.

One approach is shown in U.S. Pat. No. 6,345,698. In that patent, two rollers are independently spring mounted such that the rollers are biased into engagement with the nose of a guide rail.

There is always a need for an improved arrangement. This invention provides a unique, self-centering roller guide arrangement.

SUMMARY OF THE INVENTION

In general terms, this invention is a roller guide device that maintains appropriate contact between rollers and a guide rail and centers the roller guide, which facilitates centering the elevator cab.

One example roller device designed according to this invention includes a base. A roller mount is moveably secured to the base. Rollers are supported on the mount with their axes a fixed distance from each other. A biasing member urges the mount into a position where the rollers engage a guide rail without changing the distance between the rollers to establish appropriate roller and guide rail contact and to center the roller guide, which facilitates centering the elevator cab.

In one example, the roller mount is pivotally supported on the base so that it moves about a pivot axis responsive to the bias of the biasing member and responsive to changes in the lateral alignment of the cab with the guide rail.

In one example, the roller mount also supports low friction material inserts that slide along a corresponding surface on the nose of the guide rail. In another example, a secondary roller is supported by the base and oriented generally perpendicular to the primary rollers so that the secondary roller follows along a corresponding surface on the nose of the guide rail. Each of the two examples provides lateral car positioning in two directions.

The various features and advantages of this invention will become apparent to those skilled in the art from the following detailed description of the currently preferred embodiment. The drawings that accompany the detailed description can be briefly described as follows.

DETAILED DESCRIPTION OF THE PREFERRED EMBODIMENTS

Figure 1:
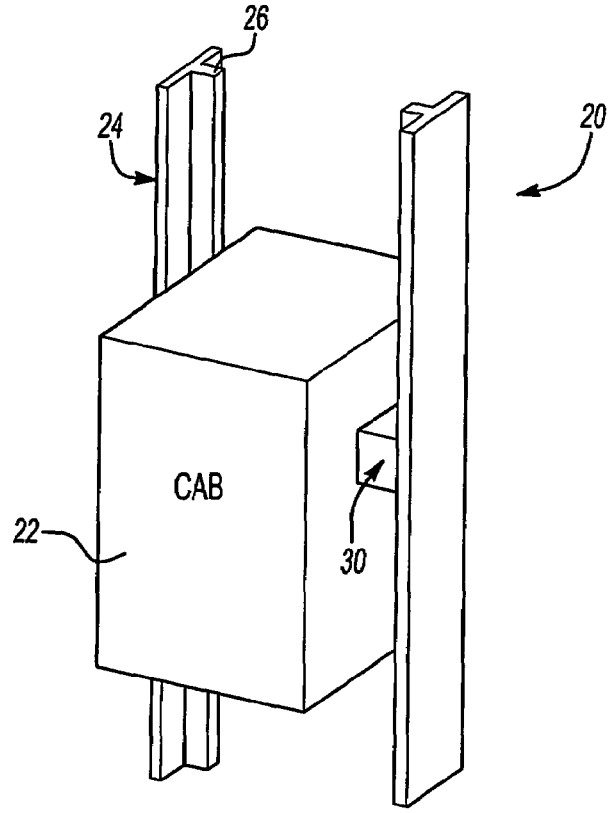
FIG. 1 schematically illustrates an elevator system including a guide device designed according to this invention.

FIG. 1 schematically illustrates an elevator system 20. An elevator cab 22 moves along guide rails 24 in a known manner. The guide rails 24 are secured within a hoistway, for example, in a conventional manner so that a nose portion 26 of the T-shaped guide rails 24 faces toward the elevator cab 22.

At least one self-centering roller guide device 30 is supported on the cab to cooperate with each of the guide rails 24. More particularly, the roller guide device 30 includes rollers that roll along the oppositely facing surfaces of the nose portion 26 of the guide rails 24.

Figure 2:
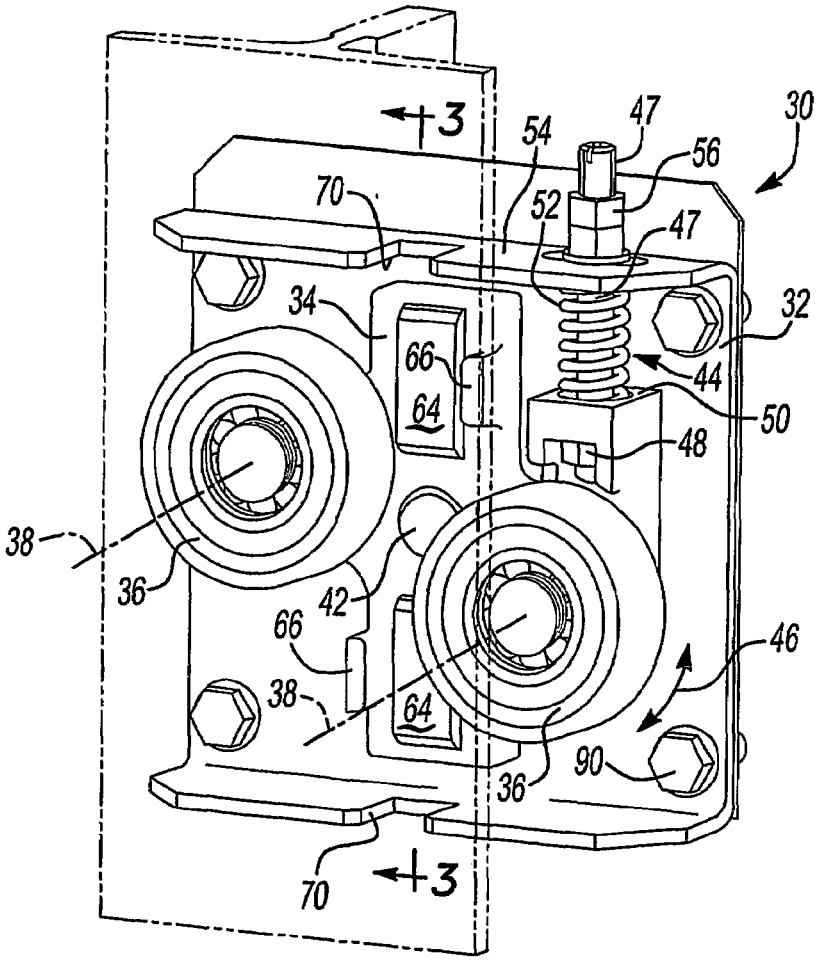
FIG. 2 is a perspective illustration of an example embodiment of a roller guide device designed according to this invention.

FIG. 2 illustrates one example roller guide device designed according to this invention. The guide device 30 includes a rigid base 32, which may be made from steel, for example. The base 32 is adapted to be mounted in a fixed position relative to the cab 22.

A roller mount 34 is moveably supported by the base 32 such that the roller mount 34 can move relative to the base 32. A set of rollers 36 are supported on the roller mount 34 using a conventional shaft and bearing arrangement, for example. The rollers 36 rotate about axes 38 that are generally perpendicular to the longitudinal axis of the corresponding guide rail 24. The axes 38 are generally parallel to the oppositely facing surfaces on the nose portion 26 along which the rollers 36 travel as the cab 22 moves up or down. The rollers 36 remain a fixed distance from each other because their axes 38 are fixed relative to the mount 34.

In the illustrated example, the roller mount 34 is supported on a shaft 42 such that the roller mount 34 can be pivoted relative to the base 32. A biasing member 44 biases the roller mount 34 as shown by the arrow 46 to adjust the position of the roller mount 34 relative to the base 32.

As the roller mount 34 pivots about the shaft 42 responsive to the force of the biasing member 44, the roller axes 38 move according to the arrow 46. By rotating or pivoting the roller mount 34 in a clockwise direction (according to the drawing) for example, the roller axes 38 both move toward a vertical center of the device 30 (according to the drawing) and, therefore, into engagement with the oppositely facing surfaces of the guide rail nose portion 26.

In the illustrated example, a single biasing member urges both rollers into engagement with the rail. Therefore, a single adjustment accomplishes the desired ride quality associated with the guiding device 30. The biasing member 44 in the illustrated example includes a threaded adjusting member 47 having a first end 48 and a second end 49. In the illustrated example, the second end 49 is similar to the head of a screw so that the threaded member 47 may be rotated using a conventional screwdriver, for example. The first end 48 in the illustrated example includes a nut that is rotationally secured by a support surface 50 on the roller mount 34. Rotating the threaded member 47 changes the distance between the support surface 50 and the second end 49 of the threaded member 47 and compresses a spring 52 a selected amount. The spring 52 provides the biasing force to urge the rollers 36 against the rail noise 26.

The threaded adjustment member 47 allows for manually compressing the spring 52 to draw the roller mount 34 into a position that facilitates installing the roller guide device 30 in an elevator system. Once the cab and roller guide are in a desired position, the adjusting member 47 can be used to adjust the tension or bias of the spring 52, which facilitates maintaining a desired amount of contact between the rollers 36 and the oppositely facing surfaces of the nose portion 26 to achieve a desired ride quality (i.e., smoothness).

The example biasing member 44 includes the spring 52 that urges the support surface 50 away from a support surface 54 on the base 32. The spring 52 allows for resiliently maintaining the roller mount 34 in a desired position. A resilient arrangement provides certain advantages so that there is some give or play in the position of the rollers 36 relative to the guide rail nose 26. Moreover, as will be described below, the biasing member urges the guide device 30 into a centered, aligned position relative to the guide rail.

In the illustrated example, locking nuts 56 secure the threaded member 47 into a desired position, which maintains a desired tension or biasing force on the roller mount 34. This typically corresponds to both rollers 36 engaging the oppositely facing surfaces of the nose portion 26 on the corresponding guide rail 24 under normal operating conditions.

The biasing member of the roller guide device 30 serves to maintain the rollers 36 in proper engagement with the guide rail 24. Additionally, the biasing member urges the roller guide device 30 into a centered position relative to the guide rail. The manner in which the roller guide is associated with the elevator cab 22 facilitates centering the cab 22 relative to the guide rails 24.

Figure 4A:
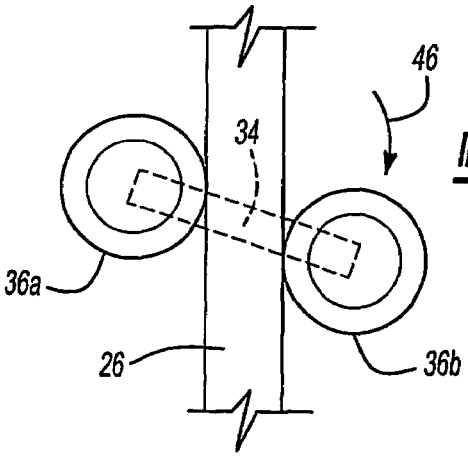
FIG. 4A schematically illustrates selected portions of the embodiment of FIG. 2 in a first operating condition.

FIG. 4A schematically shows the rollers 36 in engagement with opposite facing surfaces of the nose portion 26 of the guide rail 24. The roller 36A contacts one side of the nose portion 26 while the roller 36B contacts the other side. The force of the biasing member 44 urges the rollers 36A and 36B according to the arrow 46. This figure schematically illustrates a position of the rollers and the roller guide device under normal operating conditions.

Under some circumstances, the elevator cab 22 is subjected to forces that tend to cause lateral movement of the cab relative to the guide rails 24. A force arrow 60 schematically illustrates a lateral force causing lateral movement of the elevator cab 22. Such movement urges the roller mount 34 against the bias of the biasing member 44 as schematically shown by the arrow 62. In this situation, the roller 36A remains in contact with one side of the nose 26. The rotation of the roller mount 34 relative to the base 32 against the biasing force of the biasing member 44 results in the roller 36B no longer contacting the corresponding side of the nose portion 26.

A significant advantage to the inventive arrangement is that the force of the biasing member 44 tends to urge the rollers 36A and 36B back into the position of FIG. 4A to realign the roller guide device 30 relative to the guide rail nose portion 26 so that the roller guide 30 is returned to a centered position. Such movement also urges the cab 22 back into an aligned, centered position relative to the guide rails.

Those skilled in the art who have the benefit of this description will be able to select an appropriate biasing member having a sufficient urging force to obtain a desired amount of centered alignment of the roller guide device and elevator cab to meet the needs of their particular situation. In one example, the biasing member urges the cab back into a centered position once the laterally shifting force dissipates. In another example, the urging force of the biasing member is strong enough to resist lateral movement of the cab up to a chosen force limit.

The action of the biasing member 44 operates to center the cab in at least one lateral direction (i.e., fore and aft). Some example embodiments of this invention also include a centering feature that facilitates maintaining a lateral alignment of the cab in a perpendicular, lateral direction (i.e., side-to-side).

Figure 3:
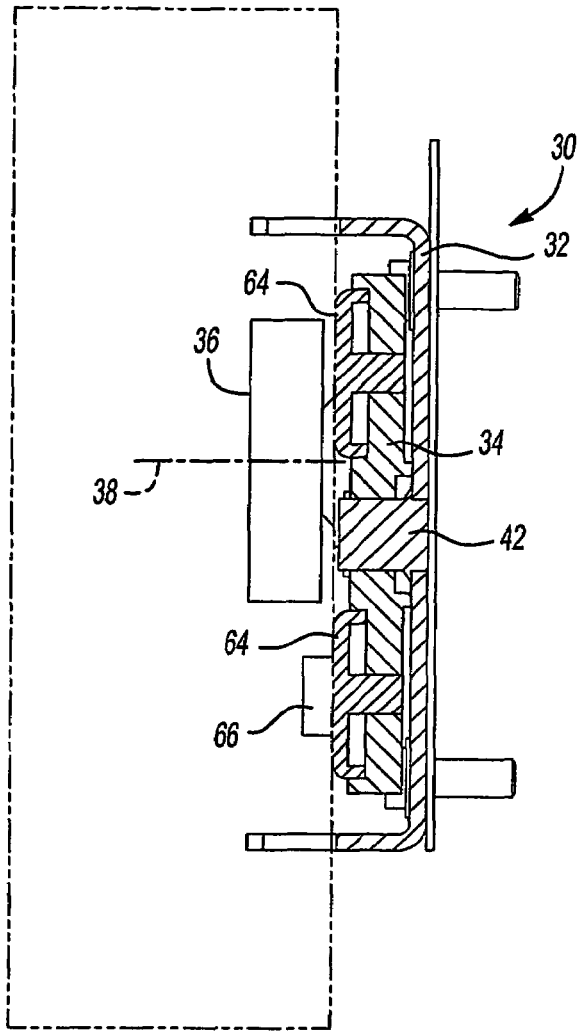
FIG. 3 is a partial, cross-sectional view taken along the lines 3-3 in FIG. 2.

As can be appreciated from FIGS. 2 and 3, the example roller mount 34 supports inserts 64 made from a commercially available, low-friction material such as plastic or Teflon. The inserts 64 are adapted to slide along an end face on the nose portion 26 of a corresponding guide rail 24. Contact between the inserts 64 and the guide rail nose 26 limits lateral movement in that direction (i.e., side-to-side).

The example roller mount 34 also includes brace members 66 that operate to limit the amount of counterclockwise (according to the drawings) rotation of the roller mount 34. The brace members 66 will engage the opposite surfaces of the nose portion 26 in the event, for example, that the elevator cab tends to move laterally beyond the anticipated resistance provided by the biasing member 44. The inventive roller device limits the amount of horizontal or lateral movement of the cab by the resistance provided by the biasing member 44 and, under some circumstances, engagement between the brace members 62 and the guide rail surfaces.

Figure 4B:
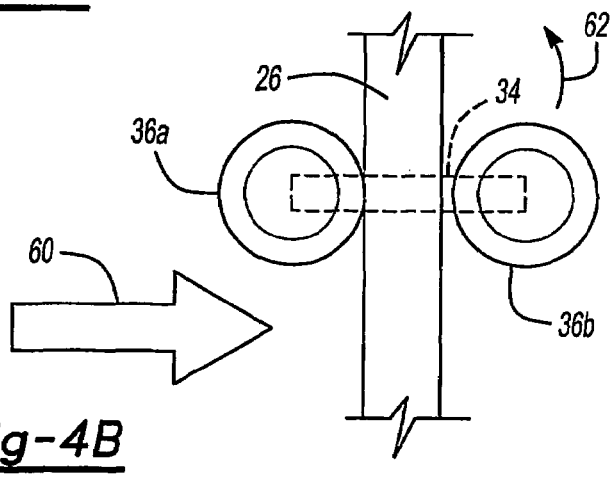
FIG. 4B schematically illustrates the selected components of FIG. 4A under different operating conditions.

Another feature of the inventive arrangement is having support surfaces 54 at the top and bottom of the base 32 extending generally perpendicular to a substantial portion of the body of the base 32. One (the top according to the drawings) of the support services 54 includes an opening 68 that receives at least a portion of the adjuster 47 and allows for adjustments to be made conveniently from above the roller guide device. Both support surfaces 54 preferably include a recess 70 that is adapted to engage the guide rail in the event of relatively large amounts of lateral cab movement, for example. Under some circumstances, lateral shifting of the cab 22 may urge the roller mount 34 into such a position (such as that shown in FIG. 4B, for example) that the side surfaces of the recesses 70 contact a corresponding surface on the nose portion 26 of the guide rail. Under such circumstances, the recesses 70 operate as a sliding type guide as known in the art. In one example, the surfaces of the recesses 70 preferably do not engage the nose portion 26 except under extreme operating conditions.

As known in the art, sliding guides typically require lubrication along the nose portion 26 of the guide rails. The inventive arrangement including the rollers 36 does not require lubrication on the guide rail surface and, therefore, the sliding, guiding operation of the recesses 70 preferably is used only on a very limited basis. In one example, the sliding, guiding function of the recesses 70 is a back up in the event that one of the rollers 36 should fail to operate as intended.

Figure 5:
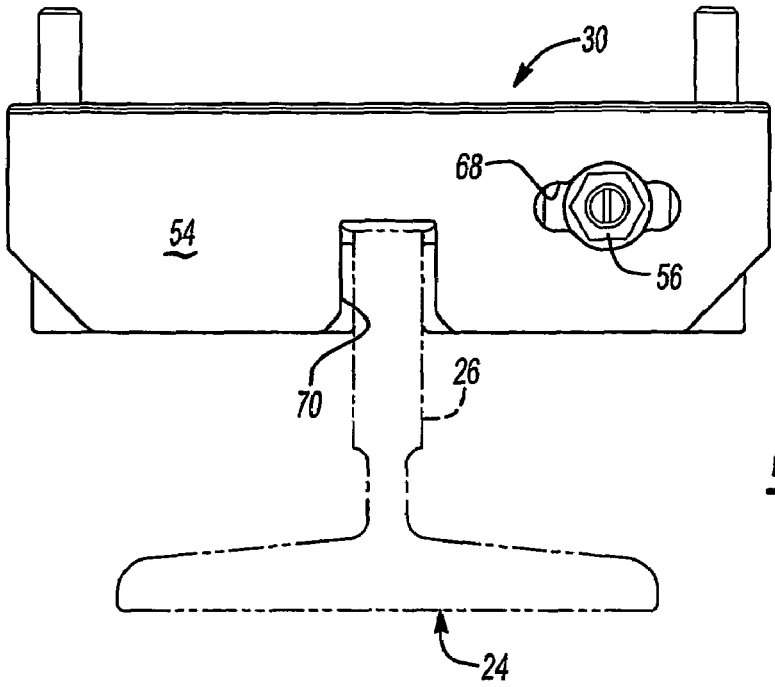
FIG. 5 is a planar view taken from the top of FIG. 2.

As can be appreciated from FIG. 5, sufficient lateral movement of the cab (i.e., from right to left in FIG. 5) would result in contact between the nose portion 26 and one of the side surfaces of the recesses 70. The inventive arrangement not only facilitates movement of the elevator cab along the guide rail but also provides control of forces perpendicular to the axes of the guide rails.

Figure 6:
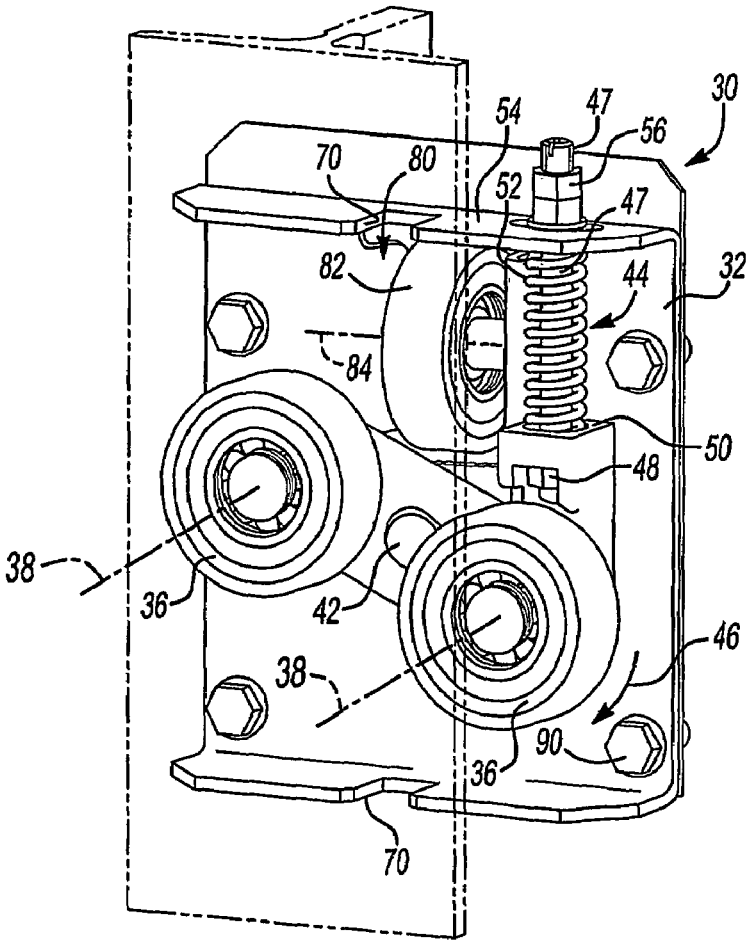
FIG. 6 is a perspective illustration of another example embodiment of a roller guide device designed according to this invention.

Another embodiment is shown in FIG. 6, which is particularly adapted for higher speed elevator operation. In this example, the base 32 includes an opening 80 through which a roller 82 at least partially protrudes. The base 32 supports the roller 82, so that it rotates about an axis 84 that is generally perpendicular to the axes 38 of the rollers 36. The roller 82 is adapted to roll along the terminal surface of the nose portion 26 as the cab moves. The roller mount 34' in this example has a different configuration compared to that shown in the example of FIGS. 2 and 3 to accommodate the roller 82. A variety of configurations are within the scope of this invention.

The roller 82 facilitates preventing lateral movement of the roller guide device 30, and therefore the cab 22, in a direction that is perpendicular to that accommodated by the biasing member 44. The example embodiment of FIG. 6, therefore facilitates maintaining a centered cab alignment in four lateral directions (i.e., fore, aft, left and right).

The inventive arrangement provides a self-centering, economical roller guide arrangement that also provides cab-centering features. One example embodiment of this invention presents cost savings and better system performance because it utilizes a roller guide arrangement that is as economical to manufacture as a typical slide-guide arrangement. The inventive arrangement also provides cost savings because it requires fewer parts, easier installation and simpler adjustment.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

I claim:

1. A device for guiding movement of an elevator cab along a guide rail, comprising:

a base;

a roller mount moveably supported by the base and pivotable about an axis;

a plurality of rollers supported on the roller mount, the rollers having roller axes that are a fixed distance apart and parallel to the axis;

a biasing member that urges the roller mount to pivot about the axis in a direction that urges one of the rollers against a first side of the guide rail and another one of the rollers against an oppositely facing second side of the guide rail, the biasing member is operative to center the base relative to the guide rail; and at least one other member that is operative to resist movement of the base in a direction parallel to the roller axes, the at least one other member being rigidly secured against movement along the direction parallel to the roller axes, the at least one other member remaining fixed relative to the base along the direction parallel to the roller axes, the at least one other member comprising at least one of an insert supported on the roller mount or a roller supported by the base and having an axis of rotation that is perpendicular to axes of the plurality of rollers.

2. The device of claim 1, wherein the biasing member urges the roller mount to rotate in one direction about the axis.

3. The device of claim 1, wherein the biasing member comprises a spring that resiliently maintains the roller mount in a selected position.

4. The device of claim 1, wherein the roller mount includes a brace member extending generally parallel to axes of the plurality of rollers and that is adapted to engage a surface on the guide rail responsive to lateral movement of the base relative to the guide rail.

5. The device of claim 1, wherein the base includes a guide surface adapted to engage a surface on a guide rail responsive to lateral movement of the base relative to the guide rail.

6. The device of claim 1, wherein the biasing member comprises a spring and a threaded member for adjusting a distance between a support surface on the roller mount and a support surface on the base to thereby selectively adjust a tension on the spring.

7. An elevator system, comprising:

at least one guide rail;

a cab that is adapted to move along the guide rail; and a guiding device associated with the cab, the guiding device including a base, a roller mount supported by the base and pivotable about an axis, a plurality of rollers supported on the roller mount, the rollers having roller axes that are a fixed distance apart and parallel to the axis, wherein the fixed distance between the roller axes establishes a distance between the rollers that is greater than a thickness of the guide rail between the first and second sides of the guide rails such that no more than one of the rollers contacts a corresponding one of the sides of the guide rail when the roller axes are along a line that is generally perpendicular to the first and second sides of the guide rail; and a biasing member that urges the roller mount to pivot about the axis in a direction that urges one of the rollers against a first side of the guide rail and another one of the rollers against an oppositely facing second side of the guide rail.

8. The system of claim 7, wherein the biasing member comprises a spring.

9. The system of claim 7, wherein the biasing member resists lateral movement of the base relative to the guide rail in a direction that is generally perpendicular to the first side of the guide rail.

10. The system of claim 9, including at least one other member adapted to resist movement of the base in a direction perpendicular to the direction of lateral movement resisted by the biasing member.

11. The system of claim 10, wherein the at least one other member comprises a low friction insert.

12. The system of claim 10, wherein the at least one other member comprises a roller.

13. The system of claim 7, comprising a shaft supported by the base, and wherein the roller mount is supported by the shaft.

14. The system of claim 13, wherein the shaft is parallel to the roller axes.

15. The system of claim 7, comprising an adjuster associated with the biasing member for adjusting a bias of the biasing member on the roller mount.

16. The system of claim 7, wherein the biasing member urges the roller mount in a direction that urges the roller axes toward a vertical center of the base.

17. The system of claim 7, comprising at least one brace member associated with the roller mount for selectively contacting the guide rail and limiting a corresponding movement of the roller mount relative to the guide rail.

18. The system of claim 17, wherein the at least one brace member is fixed to the roller mount.

19. The system of claim 7, comprising at least one support surface that remains fixed relative to the base for selectively contacting the guide rail and limiting a corresponding movement of the base relative to the guide rail.

20. The system of claim 19, wherein the support surface is near at least one end of the base and the support surface comprises a recess configured such that a side of the recess contacts the guide rail responsive to the corresponding movement of the base relative to the guide rail.

* * * * *